US007101024B2

(12) United States Patent
Lim et al.

(10) Patent No.: US 7,101,024 B2
(45) Date of Patent: Sep. 5, 2006

(54) INK-JET PRINTHEAD

(75) Inventors: Ji-hyuk Lim, Suwon-si (KR); Seog-soon Baek, Suwon-si (KR); Yong-soo Oh, Seongnam-si (KR); Keon Kuk, Yongin-si (KR); Seung-joo Shin, Seongnam-si (KR); Dong-kee Sohn, Seoul (KR); Min-soo Kim, Seoul (KR); Yong-soo Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 301 days.

(21) Appl. No.: 10/757,393

(22) Filed: Jan. 15, 2004

(65) Prior Publication Data

US 2004/0145633 A1 Jul. 29, 2004

(30) Foreign Application Priority Data

Jan. 15, 2003 (KR) ..... 10-2003-0002726

(51) Int. Cl.
*B41J 2/05* (2006.01)

(52) U.S. Cl. ..... 347/62; 347/61

(58) Field of Classification Search ..... 347/54, 347/56, 62, 63, 61
See application file for complete search history.

(56) References Cited

U.S. PATENT DOCUMENTS 6,019,457 A 2/2000 Silverbrook
6,179,411 B1 1/2001 Saikawa et al.
6,443,564 B1 9/2002 Keil et al. ..... 347/65
6,676,246 B1 * 1/2004 Anderson et al. ..... 347/62
2001/0012036 A1 8/2001 Giere et al.
2002/0012024 A1 1/2002 Lee et al.

FOREIGN PATENT DOCUMENTS

| | | |
|---|---|---|
| EP | 0 124 312 A2 | 11/1984 |
| EP | 0 124 312 A3 | 11/1984 |
| EP | 0 317 171 A2 | 5/1989 |
| EP | 0 317 171 A3 | 5/1989 |
| JP | 60-204374 | 10/1985 |
| JP | 5-338178 | 12/1993 |
| KR | 2002-00061982 | 7/2002 |

OTHER PUBLICATIONS

Patent Abstracts of Japan, vol. 0100, No. 55 (M-458), Mar. 5, 1986 & JP 60 204374.

* cited by examiner

*Primary Examiner*—An H. Do
(74) *Attorney, Agent, or Firm*—Lee & Morris, P.C.

(57) ABSTRACT

An ink-jet printhead includes an ink chamber to be filled with ink to be ejected, a manifold, which supplies ink to the ink chamber, an ink channel, which provides communication between the ink chamber and the manifold, a nozzle through which ink is ejected from the ink chamber, first and second heaters, which heat ink in the ink chamber to generate bubbles, and a conductor, which is electrically connected to the first and second heaters and applies a current to the first and second heaters, wherein the first and second heaters are positioned symmetrically around a center of the nozzle, and one of the first and second heaters is positioned adjacent to the ink channel.

19 Claims, 4 Drawing Sheets

INK-JET PRINTHEAD

BACKGROUND OF THE INVENTION

1. Field of the Invention

The present invention relates to an ink-jet printhead. More particularly, the present invention relates to an ink-jet printhead having an improved structure in which a placement of heaters improves performance and life span of the printhead.

2. Description of the Related Art

Typically, ink-jet printheads are devices for printing a predetermined image, color or black, by ejecting a small volume droplet of printing ink at a desired position on a recording sheet. Ink-jet printheads are largely categorized into two types depending on which ink droplet ejection mechanism is used. A first type is a thermally driven ink-jet printhead in which a heat source is employed to form and expand bubbles in ink causing ink droplets to be ejected. A second type is a piezoelectrically driven ink-jet printhead in which a piezoelectric material deforms to exert pressure on ink causing ink droplets to be ejected.

Hereinafter, the ink ejection mechanism in the thermally driven ink-jet printhead will be described in greater detail. When a pulse current flows through a heater formed of a resistance heating material, the heater generates heat and ink adjacent to the heater is instantaneously heated to about 300° C., thereby boiling the ink. The boiling of the ink causes bubbles to be generated, expand, and apply pressure to an interior of an ink chamber filled with ink. As a result, ink near a nozzle is ejected from the ink chamber in droplet form through the nozzle.

The thermal driving method includes a top-shooting method, a side-shooting method, and a back-shooting method depending on a growth direction of bubbles and an ejection direction of ink droplets.

The top-shooting method is a method in which the growth direction of bubbles is the same as the ejection direction of ink droplets. The side-shooting method is a method in which the growth direction of bubbles is perpendicular to the ejection direction of ink droplets. The back-shooting method is a method in which the growth direction of bubbles is opposite to the ejection direction of ink droplets.

The ink-jet printheads using the thermal driving method should satisfy the following requirements. First, manufacturing of the ink-jet printheads should be simple, costs should be low, and should permit mass production thereof. Second, in order to obtain a high-quality image, crosstalk between adjacent nozzles should be suppressed while a distance between adjacent nozzles should be narrow; that is, in order to increase dots per inch (DPI), a plurality of nozzles should be densely positioned. Third, in order to perform a high-speed printing operation, a period in which the ink chamber is refilled with ink after ink has been ejected from the ink chamber should be as short as possible and the cooling of heated ink and heater should be performed quickly to increase a driving frequency.

FIG. 1 illustrates a partial cutaway perspective view schematically showing a structure of a conventional ink-jet printhead using a top-shooting method. FIG. 2 illustrates a cross-sectional view of a vertical structure of the ink-jet printhead of FIG. 1.

Referring to FIG. 1, the conventional ink-jet printhead includes a base plate 10 formed by a plurality of material layers stacked on a substrate, a barrier wall 20 that is formed on the base plate 10 and defines an ink chamber 22, and a nozzle plate 30 stacked on the barrier wall 20. Ink is filled in the ink chamber 22, and a heater (13 of FIG. 2), which heats ink and generates bubbles, is installed under the ink chamber 22. An ink passage 24 is a path through which ink is supplied to an interior of the ink chamber 22. The ink passage 24 is in communication with an ink reservoir (not shown). Each of a plurality of nozzles 32, through which ink is ejected, is formed in a position corresponding to each ink chamber 22.

The vertical structure of the ink-jet printhead described above will be described in connection with FIG. 2.

An insulating layer 12 for providing insulation between a heater 13 and a substrate 11 is formed on the substrate 11, which is formed of silicon. The heater 13, which heats ink in the ink chamber 22 and generates bubbles, is formed on the insulating layer 12. The heater 13 is formed by depositing tantalum nitride (TaN) or tantalum-aluminum (TaAl) on the insulating layer 12 in a thin film shape. A conductor 14 for applying a current to the heater 13 is formed on the heater 13. The conductor 14 is made of a metallic material having good conductivity, such as aluminum (Al) or an aluminum (Al) alloy.

A passivation layer 15 for passivating the heater 13 and the conductor 14 is formed on the heater 13 and the conductor 14. The passivation layer 15 prevents the heater 13 and the conductor 14 from oxidizing or directly contacting ink and is formed by depositing silicon nitride. In addition, an anti-cavitation layer 16, on which the ink chamber 22 is to be formed, is formed on the passivation layer 15.

The barrier wall 20 for forming the ink chamber 22 is stacked on the base plate 10, which is formed of a plurality of material layers stacked on the substrate 11. The nozzle plate 30, in which the nozzles 32 are formed, is stacked on the barrier wall 20.

In the ink-jet printhead having the above structure, the anti-cavitation layer 16, which is formed on the passivation layer 15, prevents damage to the heater 13 due to a cavitation pressure generated during bubble collapse. However, formation of the above-described anti-cavitation layer 16 on the passivation layer 15 presents complications to the manufacture and operation of the ink-jet printhead. Specifically, such an arrangement increases the number of printhead manufacturing processes and prevents heat generated by the heater 13 from being sufficiently transferred to ink.

In order to increase the life span of a heater, an ink passage has been formed with an asymmetric structure so that cavitation occurs in another location other than the location of the heater or cavitation is distributed over a wider area to reduce a pressure thereof.

FIG. 3 illustrates a plan view of a structure of a conventional ink-jet printhead. Referring to FIG. 3, the ink-jet printhead has an asymmetric structure in which a heater 50 and a nozzle 52 are positioned off-center with respect to an ink chamber 54. An ink passage 56 supplies ink to an interior of the ink chamber 54.

The above structure causes a variation in a flow of ink to the ink chamber 54. As a result, damage to the heater 50 caused by bubble collapse is decreased.

However, in the ink-jet printhead having the above asymmetric structure, the linearity of ink droplets ejected through the nozzle 52 is lowered, and the flow of fluid disturbing an ink refill operation occurs. As such, a driving frequency of a printhead is reduced.

SUMMARY OF THE INVENTION

The present invention provides an ink-jet printhead having an improved structure in which two heaters for sequentially collapsing bubbles are positioned to increase the life span of a printhead and to improve a driving frequency of the printhead.

According to a feature of an embodiment of the present invention, an ink-jet printhead includes an ink chamber to be filled with ink to be ejected, a manifold, which supplies ink to the ink chamber, an ink channel, which provides communication between the ink chamber and the manifold, a nozzle through which ink is ejected from the ink chamber, first and second heaters, which heat ink in the ink chamber to generate bubbles, and a conductor, which is electrically connected to the first and second heaters and applies a current to the first and second heaters, wherein the first and second heaters are positioned symmetrically around a center of the nozzle, and one of the first and second heaters is positioned adjacent to the ink channel.

According to another feature of an embodiment of the present invention, an ink-jet printhead includes a substrate, an ink chamber to be filled with ink to be ejected being formed on an upper surface of the substrate, a manifold for supplying ink to the ink chamber being formed on a lower surface of the substrate, and an ink channel for providing communication between the ink chamber and the manifold being formed to be parallel to the upper surface of the substrate; and a nozzle plate, which is stacked on the substrate and forms upper walls of the ink chamber and through which a nozzle is formed in a position corresponding to a center of the ink chamber, first and second heaters for heating ink in the ink chamber and generating bubbles and a conductor being electrically connected to the first and second heaters and applying a current to the first and second heaters, wherein the first and second heaters are positioned symmetrically around a center of the nozzle, and one of the first and second heaters is positioned adjacent to the ink channel.

Preferably, a material used to form the first and second heaters is the same and a size of the first and second heaters is the same so the first and second heaters have a same resistance value. The first and second heaters may be formed of a resistance heating material selected from the group consisting of impurity-doped polycrystalline silicon, a tantalum-aluminum alloy, titanium nitride (TiN), and tungsten silicide (WSi).

The first and second heaters may be electrically connected in parallel or in series.

The nozzle plate may include a first passivation layer, a second passivation layer, and a third passivation layer, which are sequentially stacked on the substrate; the first and second heaters may be formed between the first passivation layer and the second passivation layer; and the conductor may be formed between the second passivation layer and the third passivation layer. The nozzle plate may further include a heat dissipating layer, which is stacked on the third passivation layer, that dissipates heat generated by the first and second heaters and heat remaining around the first and second heaters.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Figure 1:
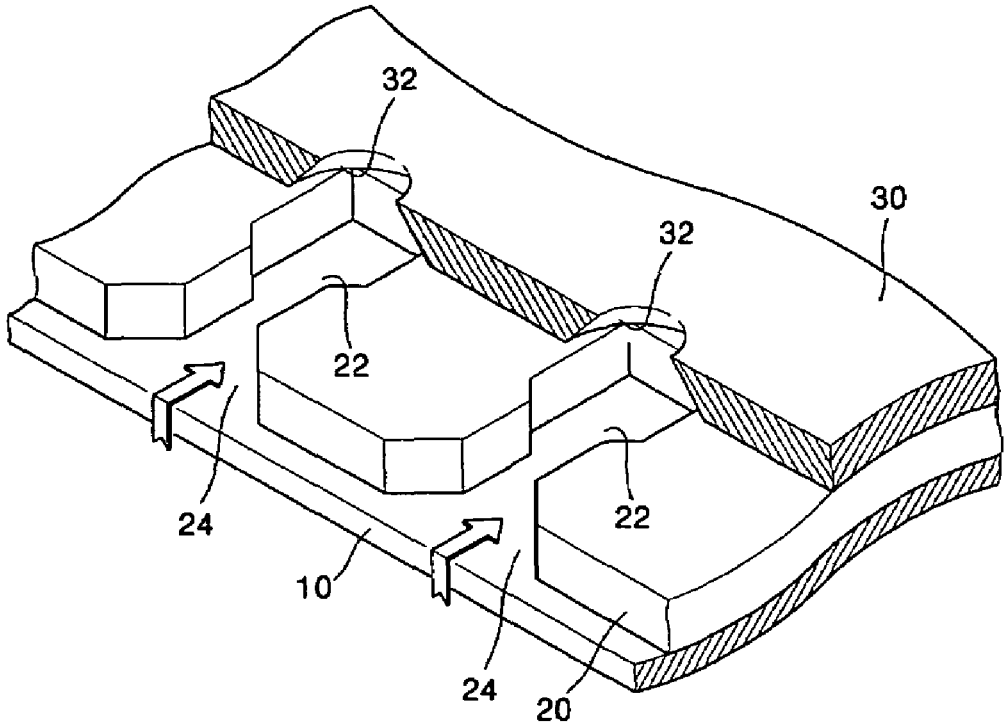
FIG. 1 (PRIOR ART)
FIG. 1 illustrates a partial cutaway perspective view of a conventional ink-jet printhead.
Figure 2:
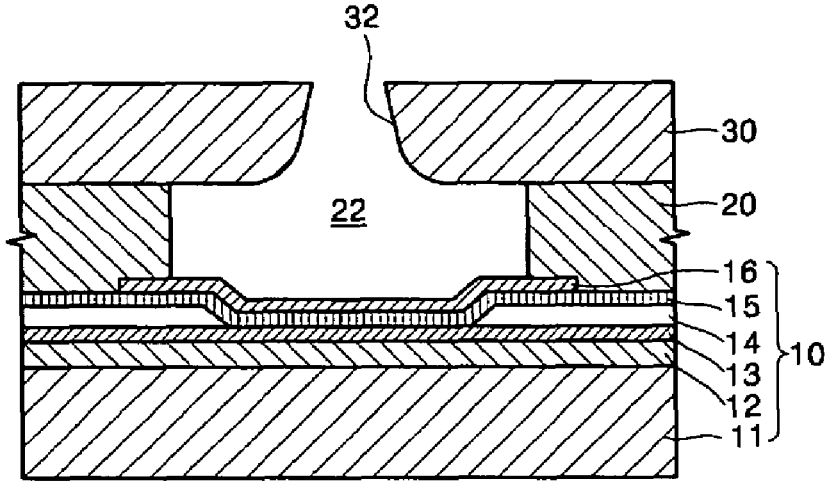
FIG. 2 (PRIOR ART)
FIG. 2 illustrates a cross-sectional view of a vertical structure of the ink-jet printhead of FIG. 1.
Figure 3:
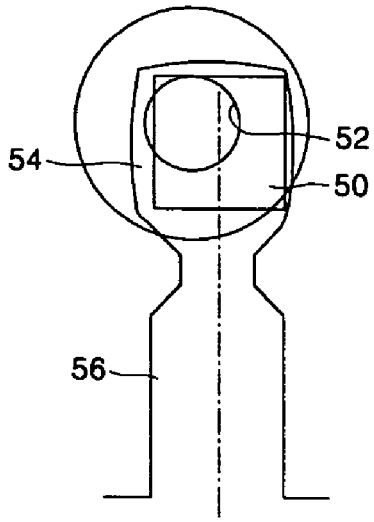
FIG. 3 (PRIOR ART)
FIG. 3 illustrates a plan view of a conventional ink-jet printhead.

Korean Patent Application No. 2003-2726, filed on Jan. 15, 2003, and entitled: "Ink-Jet Printhead," is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, the thickness of layers and regions are exaggerated for clarity. It will also be understood that when a layer is referred to as being "on" another layer or substrate, it can be directly on the other layer or substrate, or intervening layers may also be present. Like reference numerals refer to like elements throughout.

Figure 4:
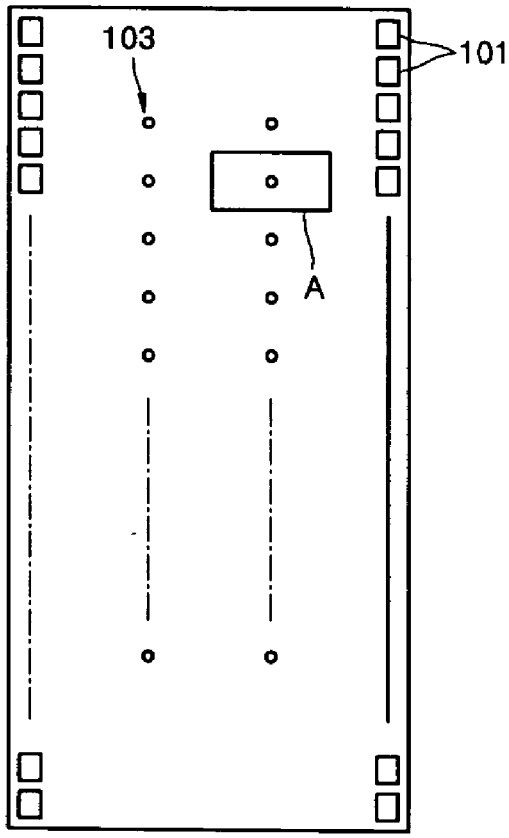
FIG. 4 illustrates a plan view of an ink-jet printhead according to an embodiment of the present invention.

FIG. 4 illustrates a plan view of an ink-jet printhead according to an embodiment of the present invention.

Referring to FIG. 4, the ink-jet printhead includes ink ejecting portions 103 disposed in two rows and bonding pads 101 that are electrically connected to each ink ejecting portion 103 on which wire bonding is to be performed. Although the ink ejecting portions 103 are exemplarily illustrated as being disposed in two rows, the ink ejecting portions 103 may be disposed in one row or in three or more rows to improve printing resolution.

Figure 5:
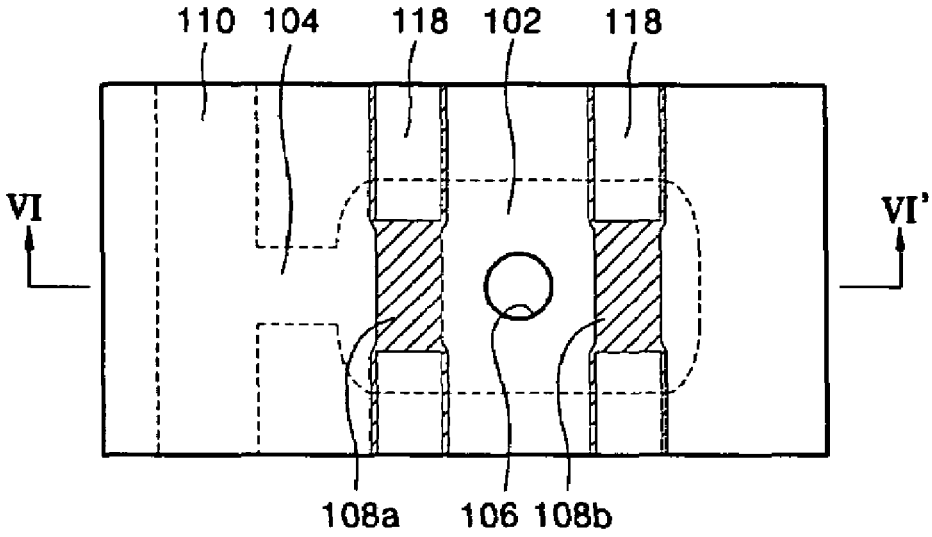
FIG. 5 illustrates an enlarged plan view of a portion A of FIG. 4.
Figure 6:
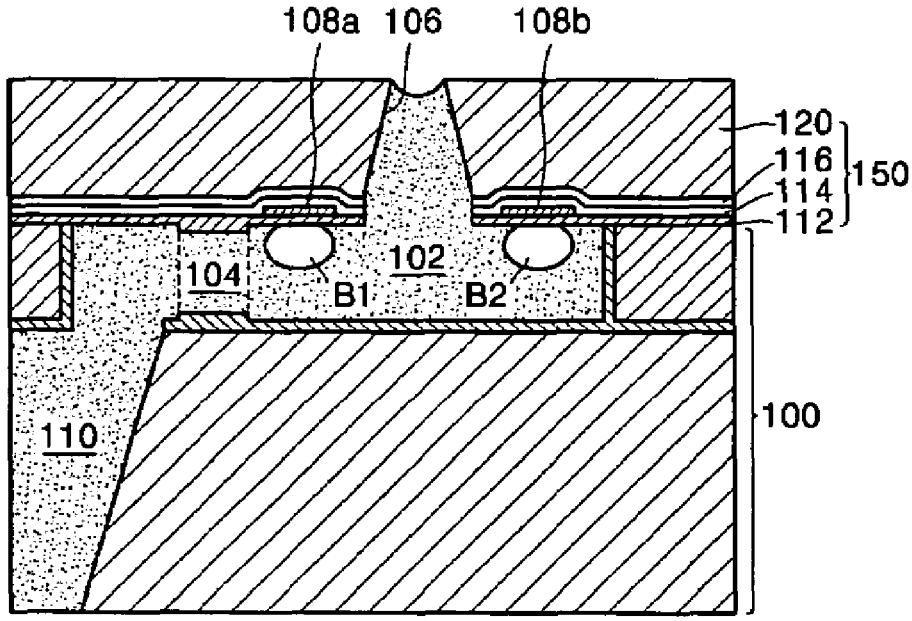
FIG. 6 illustrates a longitudinal cross-sectional view of the ink-jet printhead taken along line VI–VI' of FIG. 5.

FIG. 5 illustrates an enlarged plan view of a portion A of FIG. 4. FIG. 6 illustrates a longitudinal cross-sectional view of the ink-jet printhead taken along line VI–VI' of FIG. 5.

The structure of an ink-jet printhead according to the embodiment of the present invention will be described in detail with reference to FIGS. 5 and 6.

An ink chamber 102 to be filled with ink to be ejected is formed on an upper surface of a substrate 100. A manifold 110 for supplying ink to the ink chamber 102 is formed on a lower surface of the substrate 110. The upper surface and rear surface of the substrate 100 are etched to form the ink chamber 102 and the manifold 110. Accordingly, the ink chamber 102 and the manifold 110 may have various shapes. Here, a silicon-on-insulator (SOI) substrate may be used as the substrate 100 on which an insulating layer is interposed between two silicon layers. The manifold 110 is in communication with an ink reservoir (not shown) in which ink is stored.

An ink channel 104 for providing communication between the ink chamber 102 and the manifold 110 is formed on the upper surface of the substrate 100 between the ink chamber 102 and the manifold 110. Here, the ink channel 104 is formed to be parallel to the upper surface of the substrate 100 and perforates a sidewall of the ink chamber 102. The ink channel 104 is formed by etching the upper surface of the substrate 100, similar to the ink chamber 102. Accordingly, the ink channel 104 may have various shapes.

A nozzle plate 150 is stacked on the upper surface of the substrate 100 on which the ink chamber 102, the ink channel 104, and the manifold 110 are formed. The nozzle plate 150 forms upper walls of the ink chamber 102 and the ink channel 104. A nozzle 106, through which ink is ejected from the ink chamber 102, is formed to vertically perforate the nozzle plate 150 at a position corresponding to a center of the ink chamber 102.

The nozzle plate 150 is formed of a plurality of material layers stacked on the substrate 100.

A first passivation layer 112 is formed on the upper surface of the substrate 100. The first passivation layer 112 is a material layer for providing insulation between a first heater 108*a* and a second heater 108*b*, which will be formed on the first passivation layer 112, and the substrate 100 formed under the first passivation layer 112. The first passivation layer 112 may be formed of silicon oxide or silicon nitride.

The first and second heaters 108*a* and 108*b*, which are positioned on the ink chamber 102 and heat ink, are formed on the first passivation layer 112. The first and second heaters 108*a* and 108*b* heat ink and generate a first bubble B1 and a second bubble B2, respectively, in the ink chamber 102. Preferably, a material used to form the first and second heaters 108*a* and 108*b* is the same and a size of the first and second heaters 108*a* and 108*b* is the same so the first and second heaters 108*a* and 108*b* have a same resistance value. The first and second heaters 108*a* and 108*b* may be formed of a resistance heating material, such as impurity-doped polycrystalline silicon, a tantalum-aluminum alloy, titanium nitride (TiN), or tungsten silicide (WSi). The first and second heaters 108*a* and 108*b* may be formed by depositing the resistance heating material on an entire surface of the first passivation layer 112 to a predetermined thickness and patterning a deposited resultant. Specifically, impurity-doped polycrystalline silicon may be formed to a thickness of about 0.7–1 μm by depositing polycrystalline silicon together with impurities, for example, a source gas of phosphorous (P) using low-pressure chemical vapor deposition (LPCVD).

When the first and second heaters 108*a* and 108*b* are formed of a tantalum-aluminum alloy, titanium nitride (TiN), or tungsten silicide (WSi), the first and second heaters 108*a* and 108*b* may be formed to a thickness of about 0.1–0.3 μm by depositing a tantalum-aluminum alloy, titanium nitride (TiN), or tungsten silicide (WSi) using sputtering or chemical vapor deposition (CVD). The deposition thickness of the resistance heating material may be varied to ensure proper resistance in consideration of the widths and lengths of the first and second heaters 108*a* and 108*b*. Subsequently, the resistance heating material deposited on the entire surface of the first passivation layer 112 is patterned using a photolithographic process, which uses a photomask and a photoresist, and an etch process, which uses a photoresist pattern as an etch mask. The first and second heaters 108*a* and 108*b* may have various shapes, such as a rectangular shape as shown in FIG. 5.

The first and second heaters 108*a* and 108*b* are positioned symmetrically around a center of the nozzle 106. Here, the first heater 108*a* is positioned adjacent to the ink channel 104, and the second heater 108*b* is positioned on an opposite side of the nozzle 106 diametrically across from the first heater 108*a*. An operation of the first and second heaters 108*a* and 108*b* will be subsequently described.

A conductor 118 for applying a current to the first and second heaters 108*a* and 108*b* is electrically connected to the first and second heaters 108*a* and 108*b*. The first and second heaters 108*a* and 108*b* may be electrically connected in parallel or in series.

A second passivation layer 114 is formed on the first and second heaters 108*a* and 108*b* and the first passivation layer 112. The second passivation layer 114 is a material layer for providing insulation between the first and second heaters 108*a* and 108*b*, which are formed under the second passivation layer 114, and the conductor 118, which is formed on the second passivation layer 114. The second passivation layer 114 may be formed of silicon oxide or silicon nitride, similar to the first passivation layer 112.

The conductor 118, which is electrically connected to the first and second heaters 108*a* and 108*b* and applies a pulse current to the first and second heaters 108*a* and 108*b*, is formed on the second passivation layer 114. A first end of the conductor 118 is connected to the first and second heaters 108*a* and 108*b* via a contact hole (not shown) formed through the second passivation layer 114. A second end of the conductor 118 is electrically connected to a bonding pad (101 of FIG. 4). The conductor 118 may be formed of metal having good conductivity, such as aluminum (Al), an aluminum alloy, gold (Au), or silver (Ag).

A third passivation layer 116 is formed on the second passivation layer 114 and the conductor 118. The third passivation layer 116 may be formed of tetraethylorthosilicate (TEOS) oxide or silicon oxide.

A heat dissipating layer 120 is formed on the third passivation layer 116. The heat dissipating layer 120 is an uppermost material layer of the plurality of material layers, which form the nozzle plate 150. The heat dissipating layer 120 may be formed of a metallic material having good thermal conductivity, such as nickel (Ni), copper (Cu), or gold (Au). The heat dissipating layer 120 may be formed to a thickness of about 10–100 μm by electroplating the above metallic material on the third passivation layer 116. To provide for the electroplating, a seed layer (not shown) for electroplating of the above metallic material may be formed on the third passivation layer 116. The seed layer may be formed of a metallic material having good electrical conductivity, such as copper (Cu), chrome (Cr), titanium (Ti), gold (Au), or nickel (Ni).

The heat dissipating layer 120 dissipates heat generated by the first and second heaters 108*a* and 108*b* and heat remaining around the first and second heaters 108*a* and 108*b*. More specifically, heat generated by the first and second heaters 108*a* and 108*b* and heat remaining around the first and second heaters 108*a* and 108*b* after ink is ejected are conducted on the heat dissipating layer 120 and dissipated. Accordingly, heat is dissipated more quickly after ink is ejected, and a temperature around the nozzles 106 is lowered more rapidly. Thus, a printing operation can be stably performed at a high driving frequency.

Since the heat dissipating layer 120 is formed by a plating process, the heat dissipating layer 120 may be formed to a relatively large thickness as a single body with other elements of the ink-jet printhead, thereby providing for effective dissipation of heat. In addition, since a length of the nozzle 106 is sufficiently long, a linearity of ink droplets ejected through the nozzle 106 is improved. Thus, ink droplets can be ejected in a direction precisely perpendicular to the upper surface of the substrate 100.

In addition, the nozzle 106 formed in the nozzle plate 150 has a tapered shape such that a diameter of the nozzle decreases in a direction of an outlet. Accordingly, the ejection performance of ink droplets is improved, and an external surface of the nozzle plate 150 is prevented from becoming wet with ink.

Hereinafter, the operation of ejecting ink in the ink-jet printhead having the above structure will be described.

First, when a pulse current is applied to the first and second heaters 108*a* and 108*b* via the conductor 118 when ink fills the ink chamber 102, heat is generated by the first and second heaters 108*a* and 108*b*. The heat is transferred to ink filling the ink chamber 102 through the first passivation layer 112. As a result, ink is boiled, and first and second bubbles B1 and B2 are generated in the ink. The first and second bubbles B1 and B2 are generated from lower portions of the first and second heaters 108*a* and 108*b*. As heat is continuously supplied, the first and second bubbles B1 and B2 continuously expand. Once the bubbles have reached a predetermined size, the applied current is cut-off and the bubbles contract and collapse. As a result, ink is ejected through the nozzles 106.

In the present invention, the first and second heaters 108*a* and 108*b* are positioned symmetrically around a center of the nozzle 106. More specifically, the first heater 108*a* is positioned adjacent to the ink channel 104, through which ink flows to the ink chamber 102, and the second heater 108*b* is positioned on an opposite side of the nozzle 106 diametrically across from the first heater 108*a*. If the first and second heaters 108*a* and 108*b* are positioned symmetrically around the center of the nozzle 106, the linearity of ink droplets ejected from the ink chamber 102 is improved. In addition, the positioning of the first and second heaters 108*a* and 108*b* causes an advantageous variation in a shape of the first bubble B1 and the second bubble B2.

Figure 7:
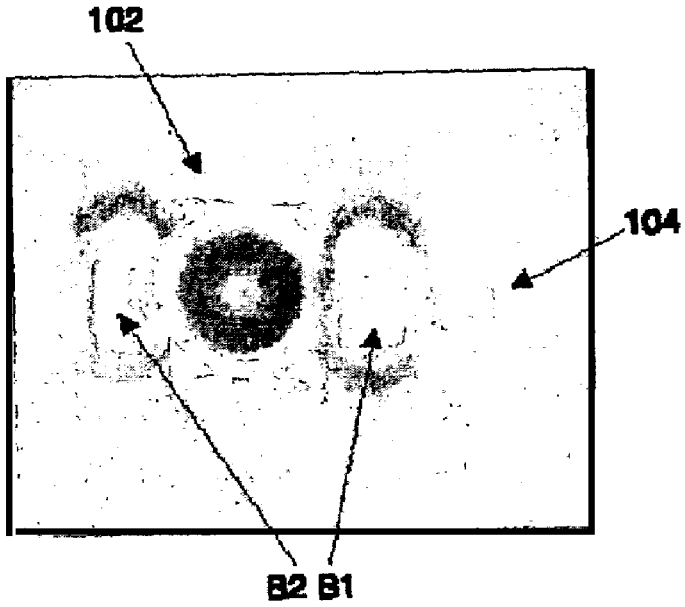
FIG. 7 is a photo showing a shape of bubbles grown in the ink-jet printhead according to the embodiment of the present invention.

FIG. 7 is a photo showing a shape of bubbles grown in the ink-jet printhead according to an embodiment of the present invention. Referring to FIG. 7, the first bubble B1 generated by the first heater 108*a* expands toward the ink channel 104 and is larger than the second bubble B2 generated by the second heater 108*b*. This difference in size is because the first bubble B1 applies a pressure to ink inside the ink channel 104 during growth, whereas the growth of the second bubble B2 is restricted by sidewalls of the ink chamber 102.

Then, when the applied current is cut-off when the expanded sizes of the first and second bubbles B1 and B2 are at a maximum, the first and second bubbles B1 and B2 contract and collapse. When this occurs, ink ejected through the nozzle 106 is separated from the nozzle 106 and is ejected in droplet form.

Meanwhile, since the first bubble B1, generated by the first heater 108*a* positioned adjacent to the ink channel 104, easily draws ink from the ink channel 104, the first bubble B1 collapses more quickly than the second bubble B2. When the first and second bubbles B1 and B2 collapse sequentially, an ink refill operation is expedited. As a result, the driving frequency of the printhead is improved. In addition, since the first and second heaters 108*a* and 108*b* are symmetrically positioned around the center of the nozzle 106, a cavitation pressure, which is generated when each of the first and second bubbles B1 and B2 collapses, is not concentrated on the center of each of the first and second heaters 108*a* and 108*b*. Instead, the cavitation pressure is scattered. Thus, damage to the first and second heaters 108*a* and 108*b* due to the cavitation pressure is prevented.

Figure 8:
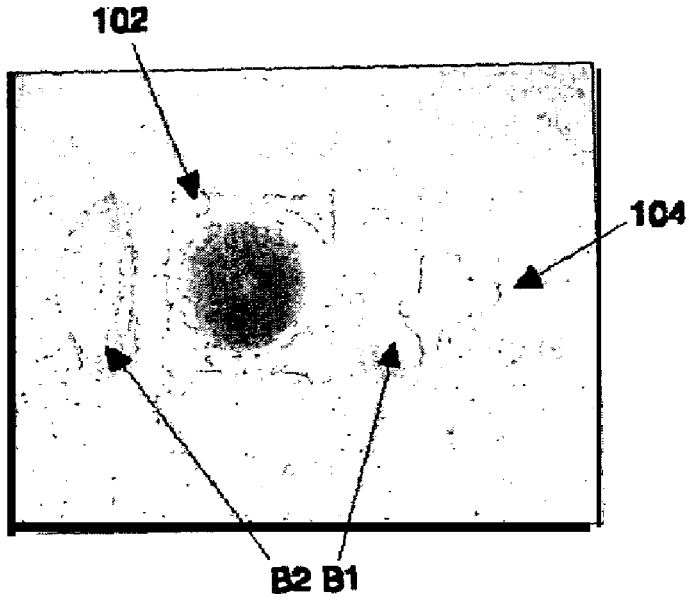
FIG. 8 is a photo showing a shape of bubbles during bubble collapse in the ink-jet printhead according to the embodiment of the present invention.

FIG. 8 is a photo showing a shape of bubbles when bubbles contract and collapse in the ink-jet printhead according to an embodiment of the present invention. Referring to FIG. 8, the first and second bubbles B1 and B2 are scattered over edges of the first and second heaters 108*a* and 108*b* and as the first and second bubbles B1 and B2 collapse, each of the first and second bubbles B1 and B2 has a half-moon shape due to a pressure of ink flowing from the ink channel 104. In addition, the first bubble B1, generated by the first heater 108*a* positioned adjacent to the ink channel 104, collapses prior to the second bubble B2.

As described above, the ink-jet printhead according to the present invention has the following advantageous effects. First, bubbles are generated by two heaters such that a cavitation pressure, generated during bubble collapse, is not concentrated on a center of a heater but is scattered. Thus, damage to the heaters due to cavitation pressure is prevented, thereby increasing the life span of the ink-jet printhead. Second, the two heaters are symmetrically positioned around the center of the nozzle 106, thereby improving the linearity of ink ejected from the ink chamber. Third, since one of the two heaters is positioned adjacent to the ink channel, and the other heater is positioned on an opposite side of the nozzle 106 diametrically across from the other heater, the bubbles sequentially collapse, thereby expediting an ink refill operation and improving the driving frequency of the printhead.

Exemplary embodiments of the present invention have been disclosed herein and, although specific terms are employed, they are used and are to be interpreted in a generic and descriptive sense only and not for purpose of limitation. For example, although an exemplary material used in forming each element of an ink-jet printhead according to the present invention has been described, a variety of materials may be used to form the elements. For example, a variety of materials having good processing properties other than silicon may be used to form a substrate. Similarly, a variety of materials may be used to form a heater, a conductor, a passivation layer, or a heat dissipating layer. Further, specific values exemplified herein may be adjusted and varied within a range in which the ink-jet printhead can operate normally. Accordingly, it will be understood by those of ordinary skill in the art that various changes in form and details may be made without departing from the spirit and scope of the present invention as set forth in the following claims.

What is claimed is:

1. An ink-jet printhead, comprising:

an ink chamber to be filled with ink to be ejected;

a manifold, which supplies ink to the ink chamber;

an ink channel, which provides communication between the ink chamber and the manifold;

a nozzle through which ink is ejected from the ink chamber;

first and second heaters, which heat ink in the ink chamber to generate bubbles; and a conductor, which is electrically connected to the first and second heaters and applies a current to the first and second heaters, wherein the first and second heaters are positioned symmetrically around a center of the nozzle, and one of the first and second heaters is positioned adjacent to the ink channel.

2. The ink-jet printhead as claimed in claim 1, wherein a material used to form the first and second heaters is the same and a size of the first and second heaters is the same so the first and second heaters have a same resistance value.

3. The ink-jet printhead as claimed in claim 1, wherein the first and second heaters are formed of a resistance heating material selected from the group consisting of impurity-doped polycrystalline silicon, a tantalum-aluminum alloy, titanium nitride (TiN), and tungsten silicide (WSi).

4. The ink-jet printhead as claimed in claim 1, wherein the first heater is positioned adjacent to the ink channel, and the first heater is positioned between the ink channel and the second heater.

5. The ink-jet printhead as claimed in claim 1, wherein the ink channel communicates with the ink chamber through an opening in a side of the ink chamber, and a distance between the first heater and the opening is less than a distance between the second heater and the opening.

6. The ink-jet printhead as claimed in claim 1, wherein the ink-jet printhead is configured such that ink entering the ink chamber from the ink channel passes the first heater before passing the second heater.

7. An ink-jet printhead, comprising:

a substrate, an ink chamber to be filled with ink to be ejected being formed on an upper surface of the substrate, a manifold for supplying ink to the ink chamber being formed on a lower surface of the substrate, and an ink channel for providing communication between the ink chamber and the manifold being formed to be parallel to the upper surface of the substrate; and a nozzle plate, which is stacked on the substrate and forms upper walls of the ink chamber and through which a nozzle is formed in a position corresponding to a center of the ink chamber, first and second heaters for heating ink in the ink chamber and generating bubbles and a conductor being electrically connected to the first and second heaters and applying a current to the first and second heaters, wherein the first and second heaters are positioned symmetrically around a center of the nozzle, and one of the first and second heaters is positioned adjacent to the ink channel.

8. The ink-jet printhead as claimed in claim 7, wherein a material used to form the first and second heaters is the same and a size of the first and second heaters is the same so the first and second heaters have a same resistance value.

9. The ink-jet printhead as claimed in claim 7, wherein the first and second heaters are formed of a resistance heating material selected from the group consisting of impurity-doped polycrystalline silicon, a tantalum-aluminum alloy, titanium nitride (TiN), and tungsten suicide (WSi).

10. The ink-jet printhead as claimed in claim 7, wherein the first and second heaters are electrically connected in parallel.

11. The ink-jet printhead as claimed in claim 7, wherein the first and second heaters are electrically connected in series.

12. The ink-jet printhead as claimed in claim 7, wherein the nozzle plate includes a first passivation layer, a second passivation layer, and a third passivation layer, which are sequentially stacked on the substrate; the first and second heaters are formed between the first passivation layer and the second passivation layer; and the conductor is formed between the second passivation layer and the third passivation layer.

13. The ink-jet printhead as claimed in claim 12, wherein the nozzle plate further includes a heat dissipating layer, which is stacked on the third passivation layer and dissipates heat generated by the first and second heaters and heat remaining around the first and second heaters.

14. The ink-jet printhead as claimed in claim 7, wherein the ink channel communicates with the ink chamber via an opening in the ink chamber, and the first and second heaters are positioned asymmetrically with respect to the opening.

15. An ink-jet printhead, comprising:

an ink ejection nozzle communicating with an ink chamber via a first opening in the ink chamber;

an ink channel communicating with the ink chamber via a second opening in the ink chamber, the ink channel coupled to a manifold; and first and second heaters disposed proximate to the ink chamber, wherein:

the first and second heaters are disposed symmetrically about the first opening, and the second opening is closer to the first heater than it is to the second heater.

16. The ink-jet printhead as claimed in claim 15, wherein the first heater, the second heater, the first opening and the second opening are formed symmetrically with respect to a virtual line.

17. The ink-jet printhead as claimed in claim 16, wherein the virtual line crosses, in sequence, the first opening, then the first heater, then the second opening, and then the second heater.

18. The ink-jet printhead as claimed in claim 15, wherein the first and second heaters are configured to heat ink filled in the ink chamber to create bubbles, and bubbles created by the first heater are larger than bubbles created by the second heater.

19. The ink-jet printhead as claimed in claim 18, wherein the ink-jet printhead is configured to collapse the bubbles when the first and second heaters are turned off, and bubbles created by the first heater collapse more quickly than bubbles created by the second heater.

* * * * *